US010533379B2

(12) United States Patent
Gylling

(10) Patent No.: US 10,533,379 B2
(45) Date of Patent: Jan. 14, 2020

(54) DOWN-THE-HOLE DRILLING DEVICE

(71) Applicant: Oy Atlas Copco Rotex AB, Tampere (FI)

(72) Inventor: Kai Gylling, Tampere (FI)

(73) Assignee: TerraRoc Finland Oy, Tampere (FI)

( * ) Notice: Subject to any disclaimer, the term of this patent is extended or adjusted under 35 U.S.C. 154(b) by 68 days.

(21) Appl. No.: 15/550,260

(22) PCT Filed: Feb. 13, 2015

(86) PCT No.: PCT/FI2015/050090
§ 371 (c)(1),
(2) Date: Aug. 10, 2017

(87) PCT Pub. No.: WO2016/128607
PCT Pub. Date: Aug. 18, 2016

(65) Prior Publication Data

US 2018/0023349 A1 Jan. 25, 2018

(51) Int. Cl.
*E21B 10/26* (2006.01)
*E21B 10/60* (2006.01)
(Continued)

(52) U.S. Cl.
CPC ..... *E21B 10/602* (2013.01); *E21B 7/20* (2013.01); *E21B 10/26* (2013.01); *E21B 10/36* (2013.01)

(58) Field of Classification Search
CPC ..... E21B 10/602; E21B 10/26; E21B 10/36; E21B 7/20
See application file for complete search history.

(56) References Cited

U.S. PATENT DOCUMENTS 3,738,435 A 6/1973 Bronson
2007/0039761 A1 2/2007 Cruz

FOREIGN PATENT DOCUMENTS

CA 2902972 A1 * 9/2014 ..... E21B 7/20
FI 124745 B 1/2015
(Continued)

OTHER PUBLICATIONS

International Search Report of PCT/FI2015/050090, dated Aug. 10, 2015.

(Continued)

*Primary Examiner* — David J Bagnell
*Assistant Examiner* — Yanick A Akaragwe
(74) *Attorney, Agent, or Firm* — Venable LLP; Jeffri A. Kaminski

(57) ABSTRACT

A down-the-hole drilling device, being meant for drilling a hole with and a casing part is described. The drilling device comprises in its drilling head: a drilling arrangement, having first drilling means for drilling a center hole and second drilling means for reaming the center hole for the casing part; and a flushing flow arrangement for feeding of a flushing medium onto a drilling surface of the drilling arrangement by one or more feed channels and for discharging the same from the drilling surface together with drilling waste. The casing part is arranged to be pulled into the hole to be drilled by power influence directed thereto from the drilling arrangement. A feed channel of the flushing flow arrangement at least partly ends up on the drilling surface at a flushing channel that exists in the longitudinal direction of the drilling device essentially behind a rearmost part of the drilling surface of at least of the first drilling means. The flushing flow arrangement comprises on the bottom of the flushing channel a supplementary flushing groove that
(Continued)

Figure 1:
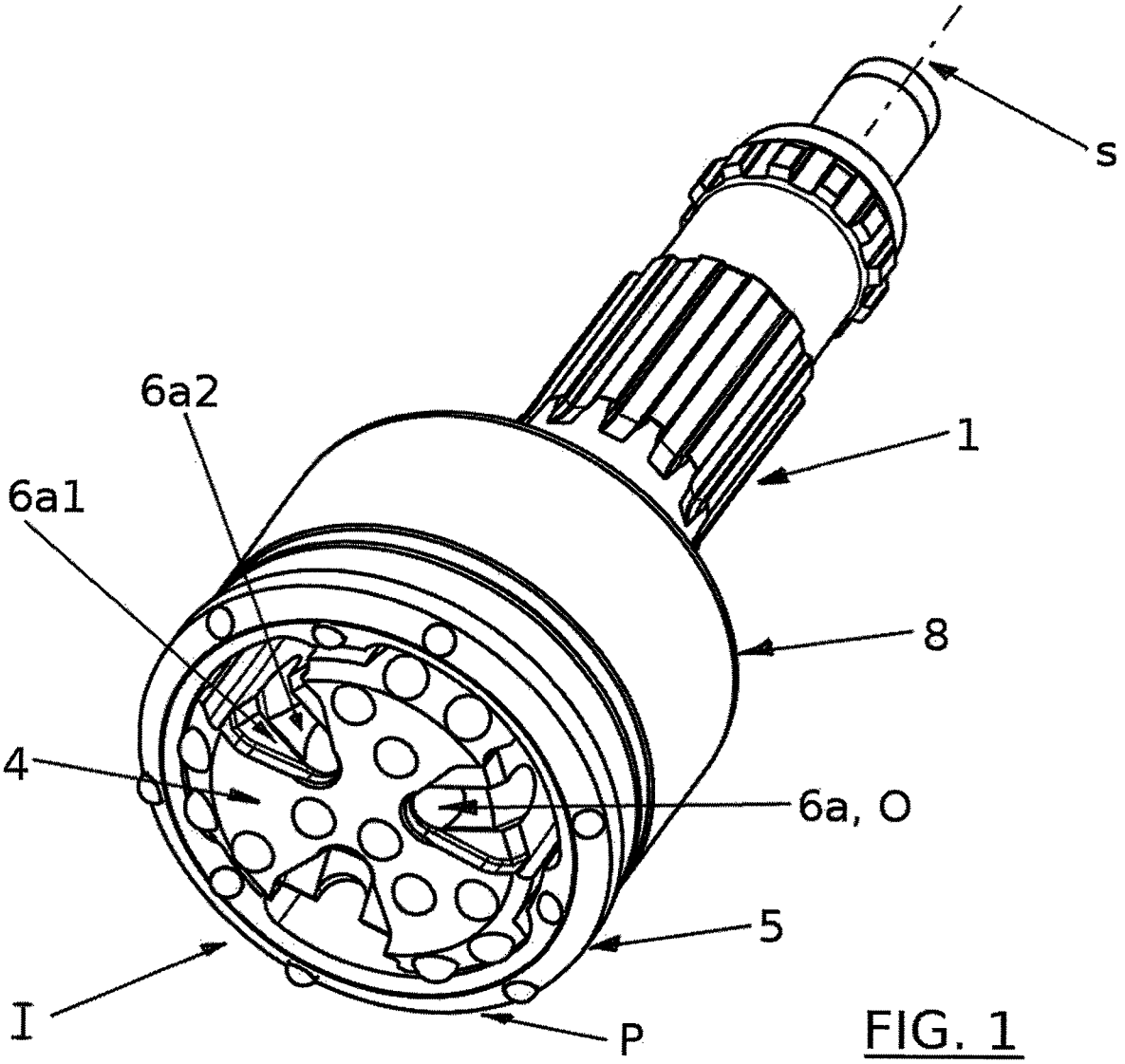

extends from the feed channel towards the outer periphery of the drilling arrangement.

10 Claims, 8 Drawing Sheets

(51) Int. Cl.
*E21B 7/20* (2006.01)
*E21B 10/36* (2006.01)

(56) References Cited

FOREIGN PATENT DOCUMENTS

| | | | |
|---|---|---|---|
| WO | 2001021930 | A1 | 3/2001 |
| WO | 2010071563 | A1 | 6/2010 |
| WO | 2015059341 | A1 | 4/2015 |

OTHER PUBLICATIONS

International Preliminary Report on Patentability of PCT/FI2015/050090, dated May 11, 2017.

* cited by examiner

DOWN-THE-HOLE DRILLING DEVICE

CROSS-REFERENCES TO RELATED APPLICATIONS

This application is a U.S. National Stage application of PCT/FI2015/050090, filed 13 Feb. 2015 and published on 18 Aug. 2016 as WO 2016/128607 which is hereby incorporated by reference in its entirety.

The invention relates to a down-the-hole drilling device according to the preamble of the independent claim directed thereto.

A way to carry out earth drilling in a developed manner with respect to traditional technique is known e.g. from Finnish Patent No. 95618. A drilling head in a drilling unit of the drilling apparatus that exists inside a casing part or in other words a so called earth pipe or casing pipe presented in this patent is formed of a first frame part and an annular second frame part, the drilling surfaces of which being provided with drilling organs, such as drill bits or like, of the first and second drilling means or in other words of a center drill or a pilot and a reaming drill or a reamer. In this solution the first frame part forming the pilot, is being released from the second frame part forming the reamer, in order to pull the same alone off from a drilled hole after the drilling situation.

The solution in question is provided with an arrangement, which locks the said drilling means together for a drilling situation unrotatively in respect with each other and in both directions longitudinally, in which context as an advantageous embodiment a bayonet coupling has been used.

After many years of experience, the drilling device according to the above mentioned patent has proved very efficient in practise and also very easy to be adjusted for different kinds of drilling purposes. E.g. regarding a drilling device of this type, there has, however, been found possibilities for making its functioning more efficient particularly in drilling of different kinds of soils. In this context modifications of the first drilling means i.e. the pilot have been developed and tested, wherein e.g. a feed channel of the flushing flow arrangement has been used, which at least partly ends up on the drilling surface at a flushing channel that exists in the longitudinal direction of the drilling device essentially lower than the lowest part of the drilling surface of the pilot. Furthermore the flushing channel on the drilling surface of the pilot has been arranged to widen in its longitudinal direction towards the outer periphery of the pilot in order to make flushing on the drilling surface more efficient.

Despite the above modifications, an adequate result has not been achieved under all circumstances particularly due to clogging of the drilling surface e.g. particularly in drilling clayey soil or soil comprising soft sand.

It is an aim of the down-the-hole drilling device according to the present invention to bring about a decisive improvement particularly in the problems described above in drilling different types of soil and thus to raise essentially the level of prior art. In order to carry out this aim, the down-the-hole drilling device according to the invention is mainly characterized by what has been presented in the characterizing part of the independent claim directed thereto.

As the most important advantages of the down-the-hole drilling device according to the invention may be mentioned simplicity of constructions and operating principle enabled by the same. The above are first of all thanks to the fact that the applicability of the drilling device, being found profitable in practice as such, can be further improved by making possible drilling with the same drilling device construction having an efficiently operating drilling face for a wide variety of soil types. Thanks to the invention, by virtue of the supplementary flushing groove on the bottom of the flushing channel, more space is left for the soil and drilling waste facing the drilling surface of the drilling device. In this context as an advantageous embodiment, a supplementary flushing groove having a constant width from an opening of the feed channel to the outer periphery of the pilot can be exploited. The drilling efficiency can be further enhanced by exploiting a supplementary flushing groove having a cross section that at least partly gets larger in its longitudinal direction. In this way removing of the drilling waste through the return flow channels on the side surface of the pilot can be made furthermore even more efficient simply by a backward sloping bottom of the supplementary flushing groove. Furthermore, as an advantageous embodiment of the invention, the side walls of the flushing channels and the supplementary flushing grooves are aligned with a plane parallel with the longitudinal direction of the drilling arrangement, in which case the longitudinal edges of the said side walls bring about more efficient cutting effect particularly in drilling of soft material and particularly clay.

By virtue of the invention, the functioning of the drilling device may be enhanced also by eliminating/retarding wear thus increasing the life time of the drilling arrangement. Thanks to the invention also the speed of drilling can be increased with respect to traditional constructions thanks to avoiding clogging of the drilling face, whereby also both air and water can be used as the flushing medium.

Other advantageous embodiments of the down-the-hole drilling device according to the invention have been presented in the dependent claims directed thereto.

Figure 2:
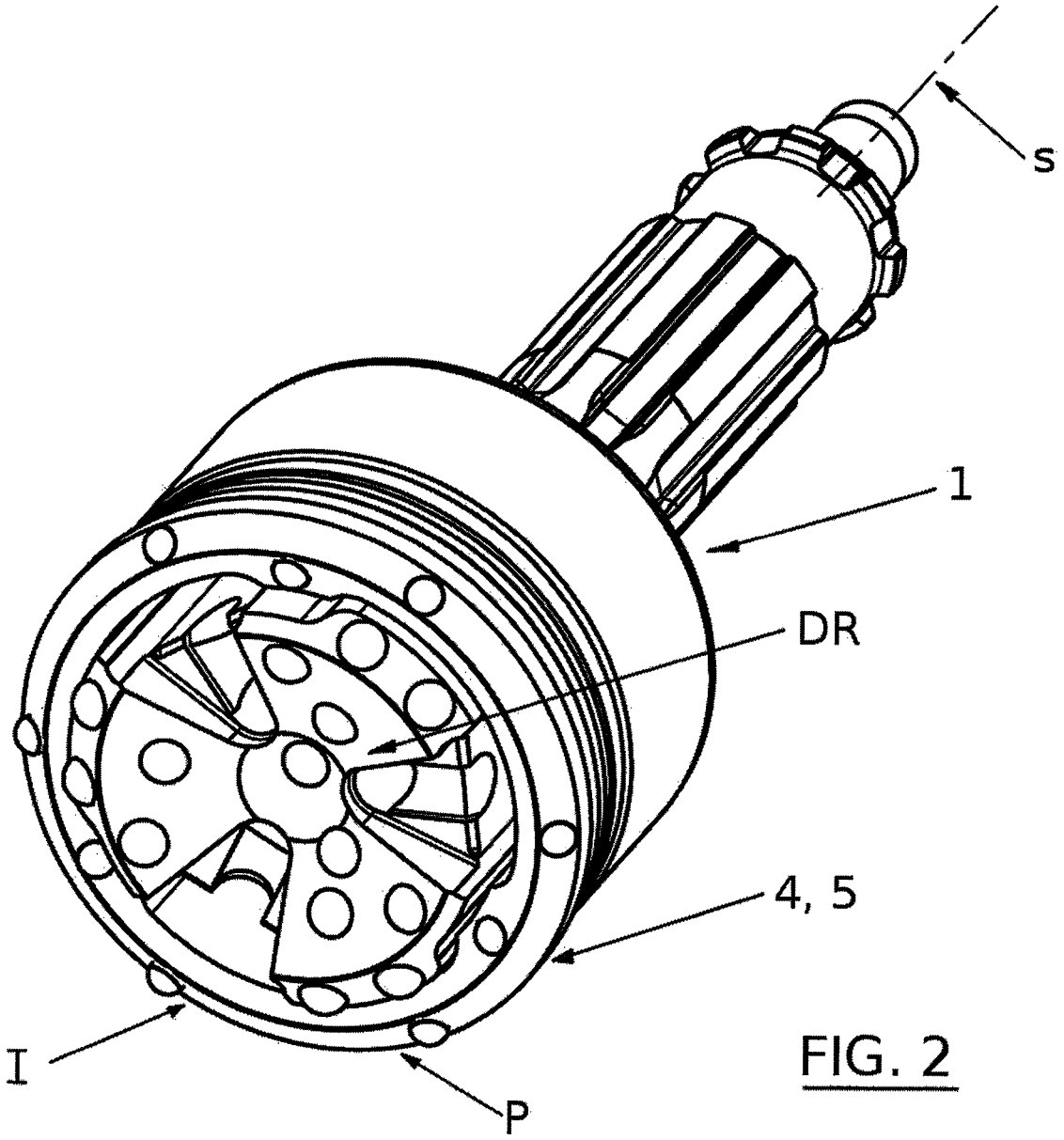
Figure 3:
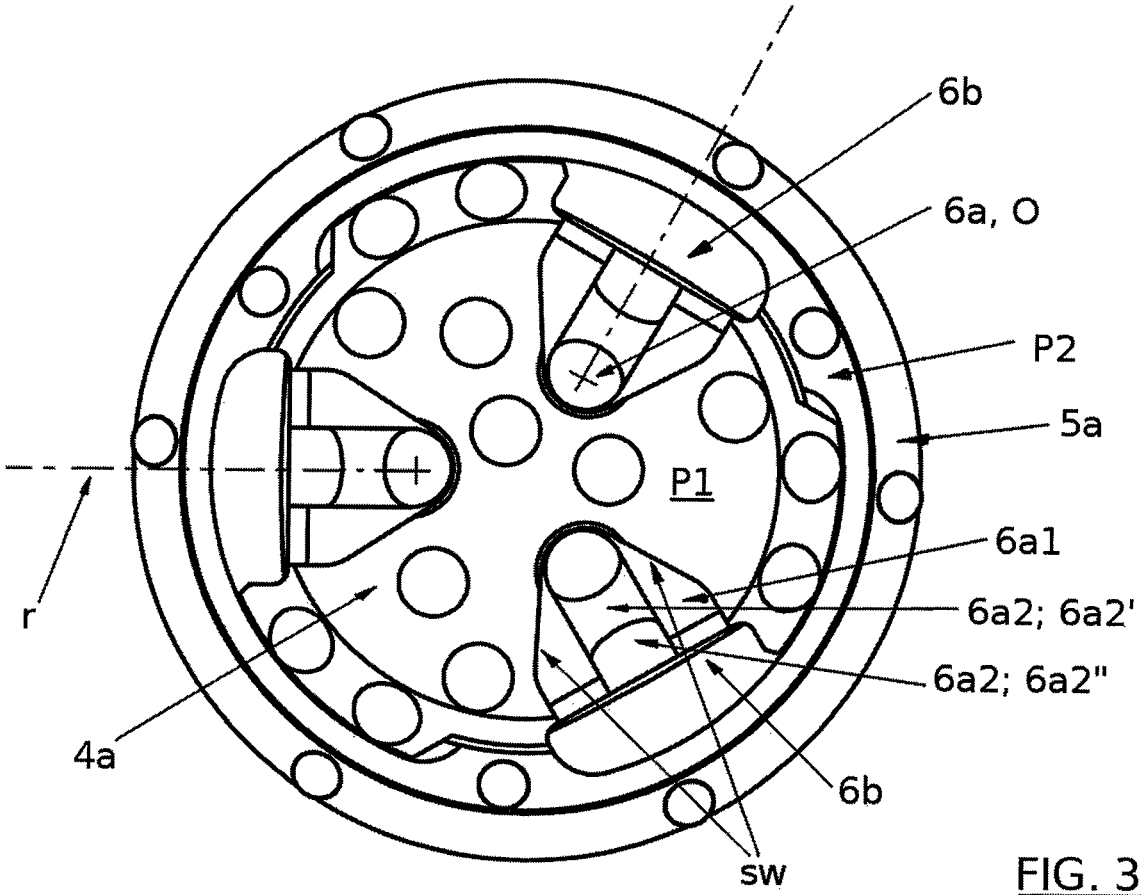
Figure 4:
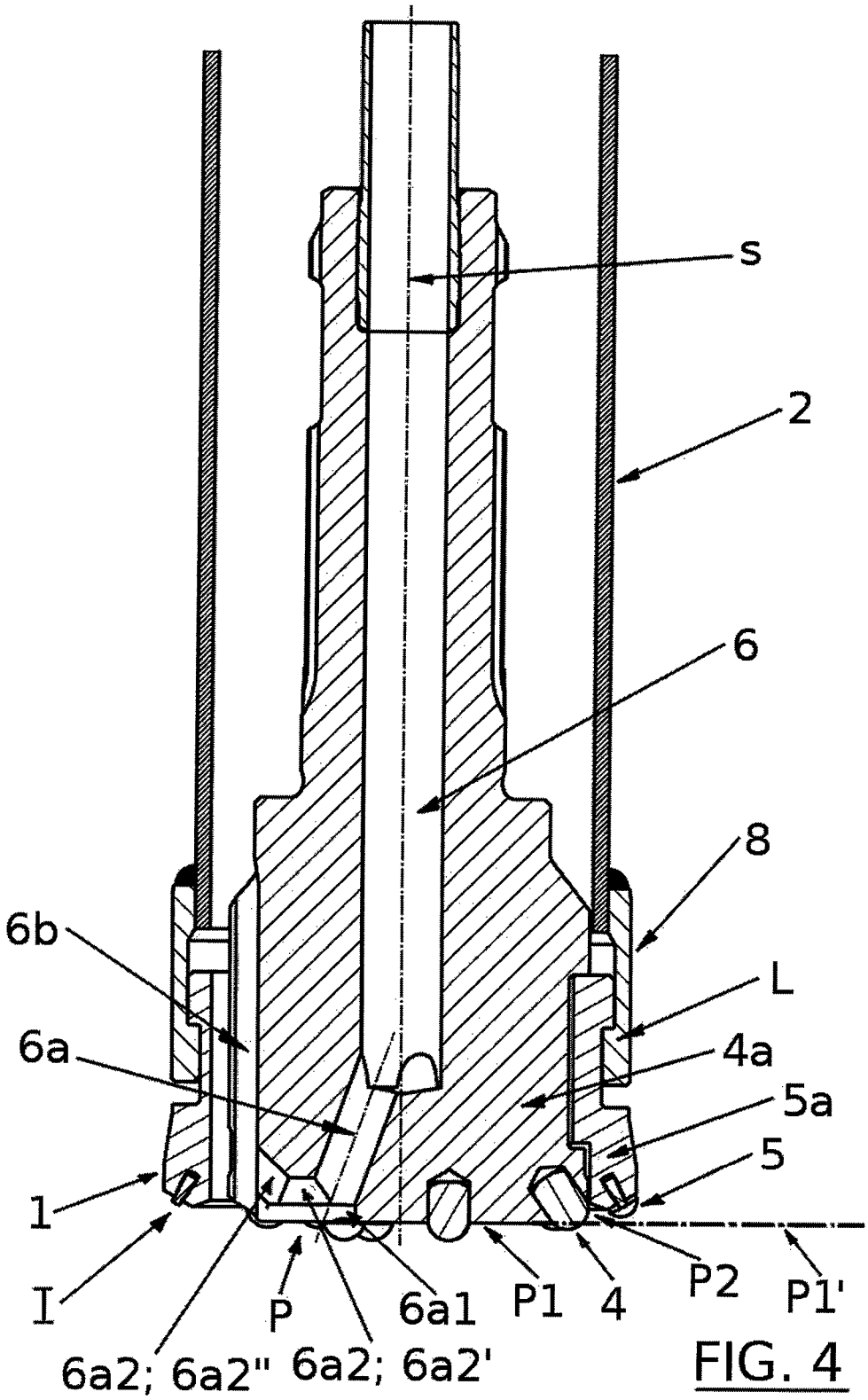
Figure 5:
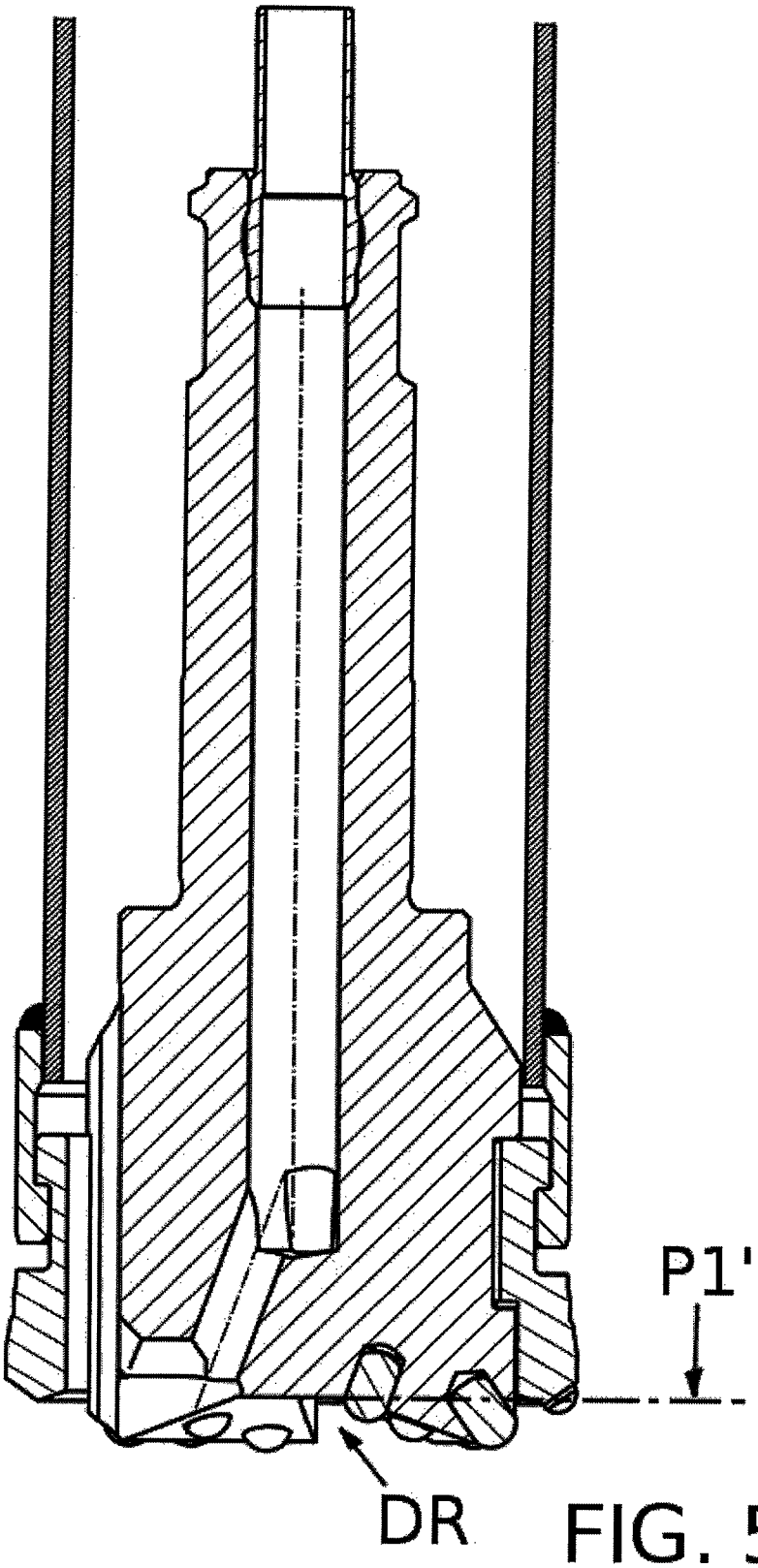
Figure 6:
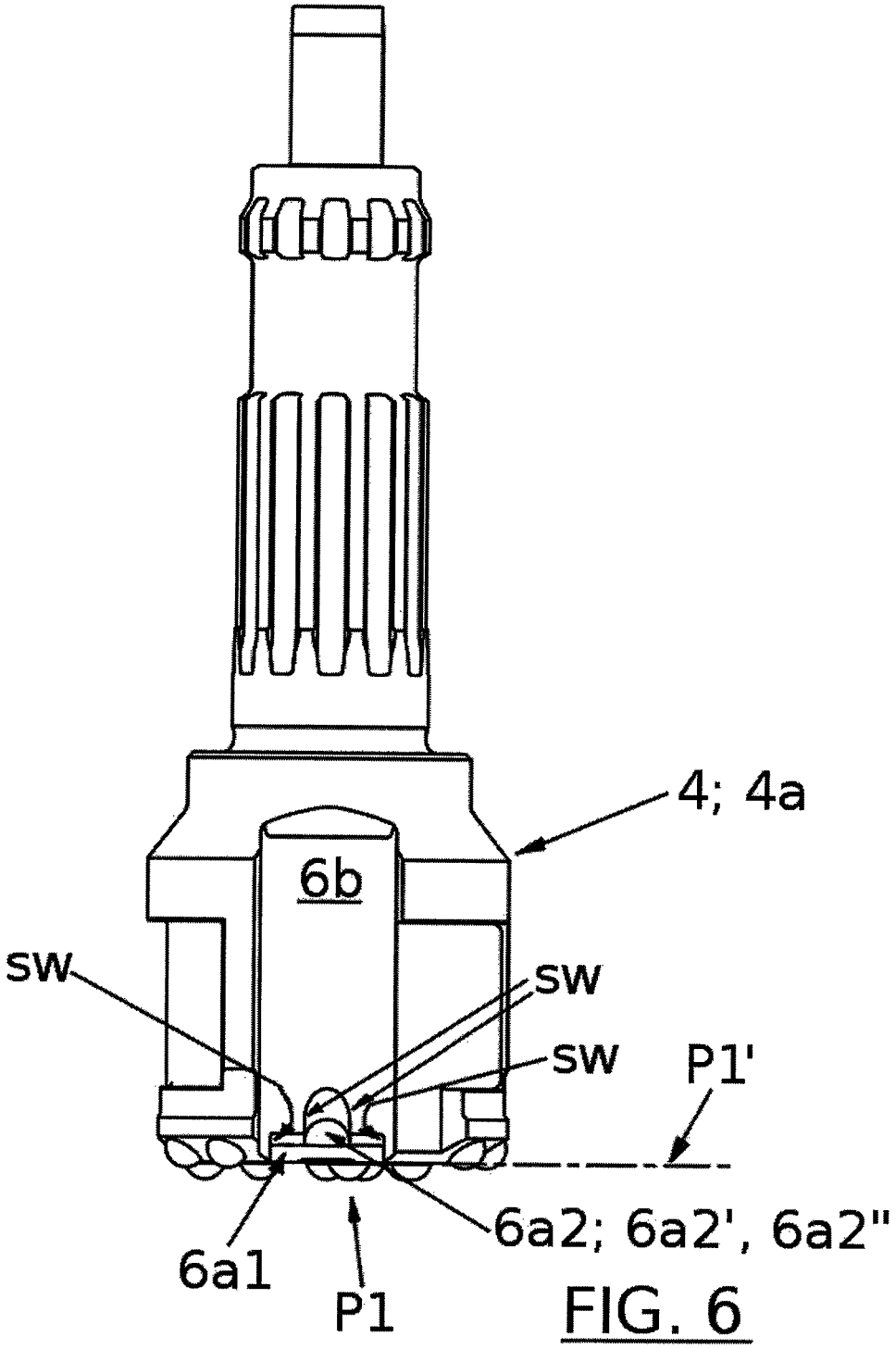
Figure 7:
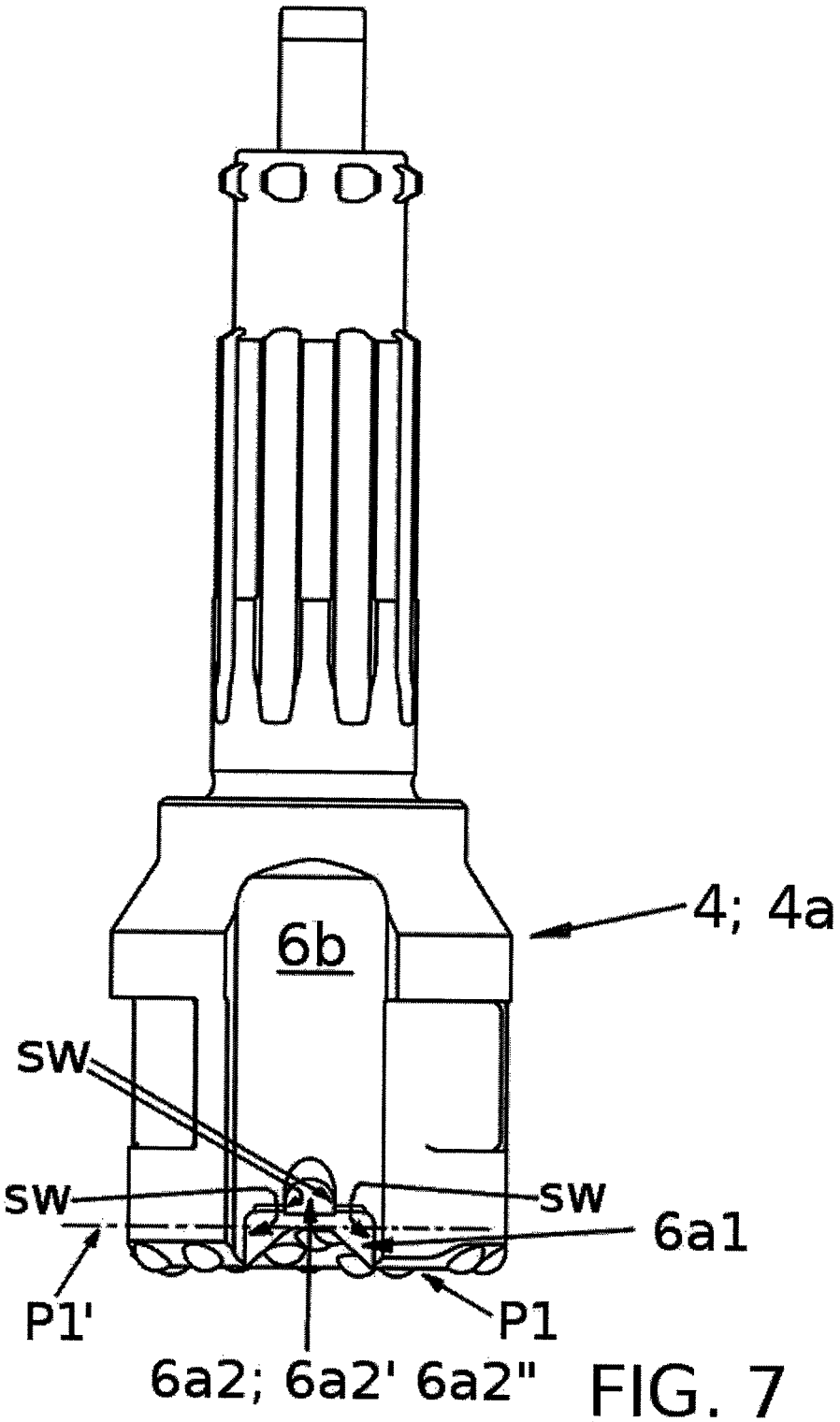
Figure 8:
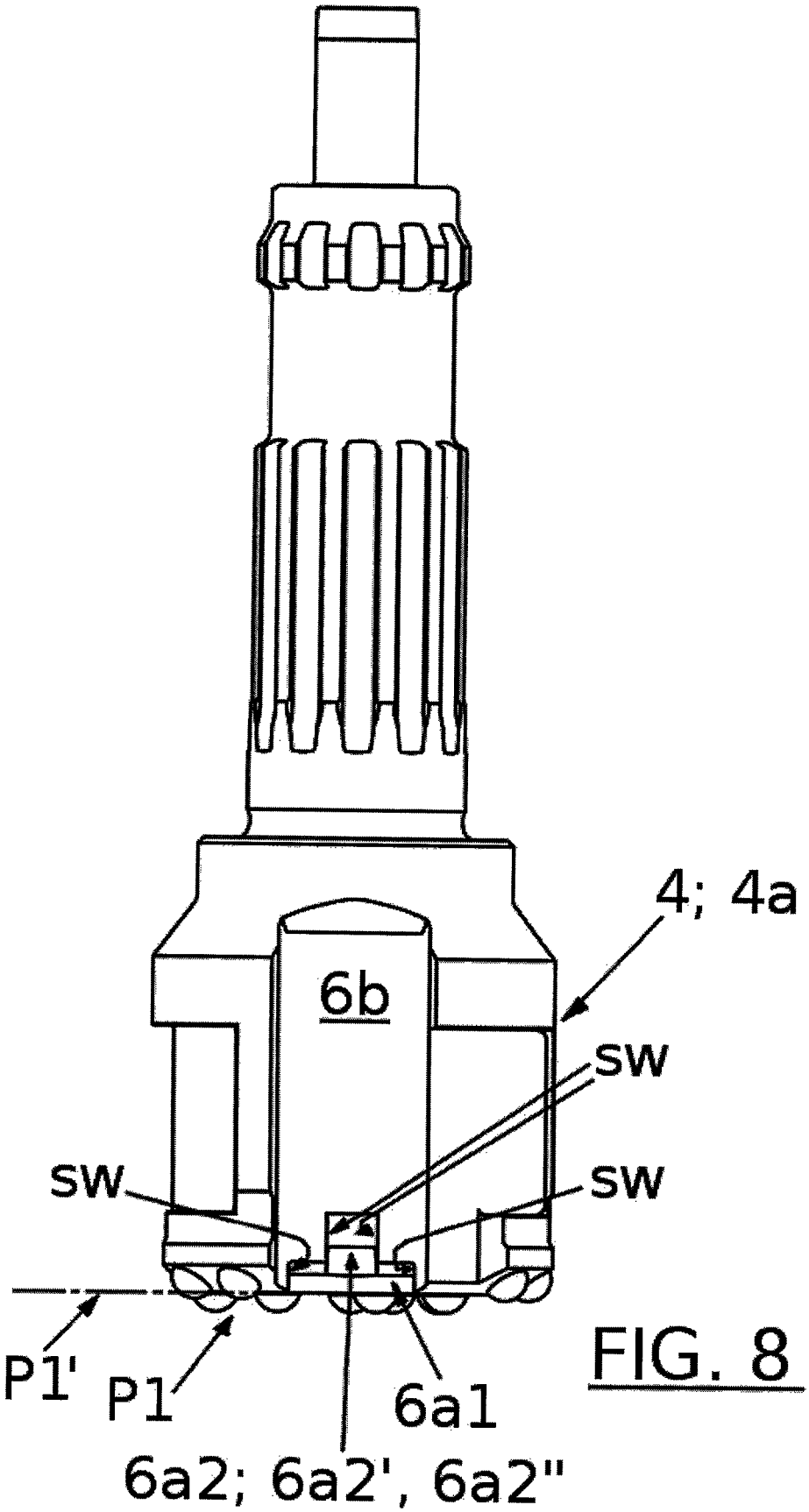

In the following description the invention is being illustrated in detail with reference to the appended drawings, in which in FIG. 1
is shown a perspective view of an advantageous down-the-hole drilling device according to the invention with a casing shoe, in FIG. 2
is shown a perspective view of an alternative down-the-hole drilling device with respect to the one shown in FIG. 1 with a casing shoe, the pilot thereof having a drop center i.e. concave front, in FIG. 3
is shown a front view of the drilling device according to FIG. 1, in FIG. 4
is shown a longitudinal cross-section of the drilling device according to FIG. 1 together with a casing shoe and a casing part, in FIG. 5
is shown a longitudinal cross-section corresponding to FIG. 4 of the drilling device according to FIG. 2, in FIG. 6
is shown a side view of the pilot of the drilling device shown in FIG. 1, in FIG. 7
is shown a side view of the pilot of the drilling device according to FIG. 2, and in FIG. 8
is shown a side view of an alternative pilot design particularly with respect to the one shown in FIG. 6.

The invention relates to a down-the-hole drilling device, being meant for drilling a hole with a casing part 2. The drilling device comprises in its drilling head I: a drilling arrangement, having first drilling means 4 for drilling a center hole and second drilling means 5 for reaming the center hole for the casing part 2; and a flushing flow arrangement 6 for feeding of a flushing medium onto a drilling surface P of the drilling arrangement by one or more feed channels 6*a* and for discharging the same from the drilling surface P together with drilling waste backwards with respect to the drilling direction. The casing part 2 is arranged to be pulled into the hole to be drilled by power influence directed thereto from the drilling arrangement, such as the first and/or the second drilling means 4, 5. A feed channel 6*a* of the flushing flow arrangement 6 at least partly ends up on the drilling surface P at a flushing channel 6*a*1 that exists in the longitudinal direction s of the drilling device essentially behind a rearmost part P1' of the drilling surface P1 of at least of the first drilling means 4 as shown in FIGS. 4-8. The flushing flow arrangement 6 comprises on a bottom of the flushing channel 6*a*1 a supplementary flushing groove 6*a*2 as seen in FIGS. 1, 2, 4-8 that extends from the feed channel 6*a* towards the outer periphery of the drilling arrangement.

As an advantageous embodiment of the down-the-hole drilling device according to the invention, the drilling head I of the drilling device 1 consists of a first frame part 4*a* and a second frame part 5*a*. The drilling surfaces P1, P2 formed of end surfaces of the frame parts are provided with drilling organs of the first and the second drilling means 4, 5, such as an integrated drilling part, separate drilling pieces, bits or like. The essentially rotationally symmetrical first and second drilling means 4, 5 are coupled with each other on the first hand at least during a drilling situation in a power transmitting manner by means of a coupling arrangement in order to carry out co-operation thereof for a rotational motion, a feeding motion and/or a hammering motion and on the other hand removably in order to enable removal of the first drilling means from a drilled hole. The drilling arrangement is provided with a casing shoe 8 as shown e.g. in FIGS. 4 and 5 for pulling the casing part 2 into the hole by means of a shoulder arrangement L enabling an independent rotational movement of the casing part 2 and the drilling device 1 with respect to each other and restricting mutual longitudinal s movement thereof. With reference e.g. to FIGS. 4 and 5, the flushing flow arrangement 6 comprises one or more longitudinal s return flow channels 6*b* on the side surface of the first drilling means 4 for removing drilling waste between the first and second drilling means 4, 5 inside the casing part 2. The flushing channel 6*a*1 on the drilling surface P1 of the first drilling means 4 widens in its longitudinal direction r towards the outer periphery of the first drilling means 4. The supplementary flushing groove 6*a*2 has a constant width from an opening O of the feed channel 6*a* in the flushing channel 6*a*1 to the outer periphery of the first drilling means 4, such as the first frame part 4*a*.

As a furthermore advantageous embodiment of the down-the-hole drilling device according to the invention, the supplementary flushing groove 6*a*2 may be constructed to have a cross section perpendicular to its longitudinal direction r that remains constant for the whole length thereof (this kind of embodiment has not been shown in the drawings).

The drilling devices in the drawings 1, 3, 4, 6 and 8 have a pilot 4; 4*a* with a planar drilling surface P1, when instead the drilling devices shown in FIGS. 2, 5 and 7 have a pilot with a drop center i.e. concave front DR.

As a furthermore advantageous embodiment of the down-the-hole drilling device 1 according to the invention, the supplementary flushing groove 6*a*2 has a cross section perpendicular to its longitudinal direction r that at least partly gets larger in its longitudinal direction r.

Furthermore, as an advantageous embodiment of the down-the-hole drilling device according to the invention, the supplementary flushing groove 6*a*2 is connected to a return flow channel 6*b* of the flushing flow arrangement 6 for returning of the flushing medium together with drilling waste on the side surface of the first drilling means 4 with a part 6*a*2' having a backward sloping bottom as shown e.g. in FIGS. 4 and 5.

Furthermore, as an advantageous embodiment of the down-the-hole drilling device according to the invention, the supplementary flushing groove 6*a*2 comprises a part 6*a*2" with a bottom in an essentially transverse plane with respect to the longitudinal direction s of the drilling device as shown e.g. in FIGS. 4 and 5.

Furthermore, as an advantageous embodiment of the down-the-hole drilling device according to the invention, the cross section of the supplementary flushing groove 6*a*2 perpendicular to its longitudinal direction r is arched as shown e.g. in FIGS. 6 and 7.

As a furthermore advantageous embodiment of the down-the-hole drilling device according to the invention, the cross section of the supplementary flushing groove 6*a*2 perpendicular to its longitudinal direction r is essentially rectangular or square shaped as shown e.g. in FIG. 8.

With reference e.g. to FIGS. 6-8, as a furthermore advantageous embodiment of the down-the-hole drilling device according to the invention, the essentially planar bottom of the flushing channel 6*a*1 and/or the supplementary flushing groove 6*a*2 is connected in a rounded manner to the respective sidewalls sw thereof.

Furthermore, as an advantageous embodiment of the down-the-hole drilling device according to the invention, the sidewalls sw of the one or more flushing channels 6*a*1 and/or supplementary flushing grooves 6*a*2 are aligned with a plane parallel with the longitudinal direction s of the drilling device, thanks to which the longitudinal edges of the said channels improve radically the drilling efficiency of the drilling device in drilling of most heterogeneous soil types.

It is clear that the invention is not limited to the embodiments shown or described above, but instead it can be modified within limits of the basic idea of the present invention according to the needs at any given time. It is thus clear, that the constructions of the drilling devices being illustrated in the drawings may vary in practice very much merely when being carried out with differing diameters. Furthermore a supplementary flushing groove can be exploited, the width of which increases in its longitudinal direction, or the bottom of which may be sloped backward in an arched manner. Also the one or more feed channels, the flushing channels and/or the supplementary flushing grooves may be arranged in more or less sloped positions than shown in the drawings. Furthermore bevellings in different corners of the drilling device constructions shown in the drawings can be replaced by more or less rounded shapes etc. On the other hand, instead of the type of embodiments shown in the drawings, it is naturally possible to use as the drilling device also other drilling devices that are applicable for the same purpose, in which a casing part may be exploited in connection with the drilling that is drawn into the ground unrotatively without or with a casing shoe. The casing part can naturally also be pulled into the hole by the first frame part i.e. the pilot, in which case the second frame part i.e. the reamer, such as a "reaming ring", may be situated further back in the longitudinal direction than the reamers presented in the drawings. It is not that significant for the down-the-hole drilling device according to the invention, either, how the first and second drilling means are coupled with each other, so that a wide variety of different solutions can be exploited as the power transmission assemblies between the same.

The invention claimed is:

1. Down-the-hole drilling device, being meant for drilling a hole with a casing part, wherein the drilling device comprises in its drilling head: a drilling arrangement, having first drilling means for drilling a center hole and second drilling means for reaming the center hole for the casing part; and a flushing flow arrangement for feeding of a flushing medium onto a drilling surface of the drilling arrangement by one or more feed channels and for discharging the same from the drilling surface together with drilling waste backwards with respect to the drilling direction, wherein the casing part is arranged to be pulled into the hole to be drilled by power influence directed thereto from the drilling arrangement, such as the first and/or the second drilling means, and wherein the one or more feed channels of the flushing flow arrangement ends up on the drilling surface, to direct the flushing medium flow into the soil through a feed channel opening thereof on the drilling surface, the opening existing in a transverse plane with respect to the longitudinal direction of the drilling device, at a flushing channel having a bottom and that exists in the longitudinal direction of the drilling device essentially behind a rearmost part of the drilling surface of at least of the first drilling means, wherein the flushing flow arrangement comprises on the bottom of the flushing channel a supplementary flushing groove having a smaller transverse width than a width of the bottom of the flushing channel and that extends from the feed channel towards the outer periphery of the drilling arrangement, wherein the flushing channel extends from the opening toward an outer periphery of the first drilling means, and wherein the opening is aligned with a rounded end of the flushing channel and a rounded end of the supplementary flushing groove.

2. Down-the-hole drilling device according to claim 1, the drilling head of the drilling device consists of a first frame part and a second frame part, wherein the drilling surfaces formed of end surfaces of the frame parts are provided with drilling organs of the first and the second drilling means, such as an integrated drilling part, separate drilling pieces, bits or like, wherein the essentially rotationally symmetrical first and second drilling means are coupled with each other on the first hand at least during a drilling situation in a power transmitting manner by means of a coupling arrangement in order to carry out co-operation thereof for a rotational motion, a feeding motion and/or a hammering motion and on the other hand removably in order to enable removal of the first drilling means from a drilled hole, wherein the drilling arrangement is provided with a casing shoe for pulling the casing part into the hole by means of a shoulder arrangement enabling an independent rotational movement of the casing part and the drilling device with respect to each other and restricting mutual longitudinal movement thereof, wherein the flushing flow arrangement comprises one or more longitudinal return flow channels on the side surface of the first drilling means for removing drilling waste between the first and second drilling means inside the casing part, and wherein the flushing channel on the drilling surface of the first drilling means widens in its longitudinal direction towards the outer periphery of the first drilling means, wherein the supplementary flushing groove has a constant width from an opening of the feed channel in the flushing channel to the outer periphery of the first drilling means, such as the first frame part.

3. Down-the-hole drilling device according to claim 1, wherein the supplementary flushing groove has a cross section perpendicular to its longitudinal direction that remains constant for the whole length thereof.

4. Down-the-hole drilling device according to claim 1, wherein the supplementary flushing groove has a cross section perpendicular to its longitudinal direction that at least partly gets larger in its longitudinal direction.

5. Down-the-hole drilling device according to claim 4, wherein the supplementary flushing groove is connected to a return flow channel of the flushing flow arrangement for returning of the flushing medium together with drilling waste on the side surface of the first drilling means with a part having a backward sloping bottom.

6. Down-the-hole drilling device according to claim 4, wherein the supplementary flushing groove comprises a part with a bottom in an essentially transverse plane with respect to the longitudinal direction of the drilling device.

7. Down-the-hole drilling device according to claim 1, wherein the cross section of the supplementary flushing groove perpendicular to its longitudinal direction is arched.

8. Down-the-hole drilling device according to claim 1, wherein the cross section of the supplementary flushing groove perpendicular to its longitudinal direction is essentially rectangular or square shaped.

9. Down-the-hole drilling device according to claim 1, wherein the essentially planar bottom of the flushing channel and/or the supplementary flushing groove is connected in a rounded manner to the respective sidewalls thereof.

10. Down-the-hole drilling device according to claim 1, wherein the sidewalls of the one or more flushing channels and/or supplementary flushing grooves are aligned with a plane parallel with the longitudinal direction of the drilling device.

* * * * *